US005199560A

United States Patent [19]

Lee et al.

[11] Patent Number: 5,199,560

[45] Date of Patent: Apr. 6, 1993

[54] KEY CASE WITH RETRACTABLE KEYS

[76] Inventors: Dong H. Lee, 5113 Ramsdell Ave., La Crescenta, Calif. 91214; Jae W. Hyun, 39 Penny La., Scarsdale, N.Y. 10583

[21] Appl. No.: 937,141

[22] Filed: Aug. 31, 1992

[51] Int. Cl.[5] ..... A45C 11/32

[52] U.S. Cl. ..... 206/37.3; 206/37.4; 206/37.5; 206/37.6

[58] Field of Search ..... 206/37.1, 37.2, 37.3, 206/37.4, 37.5, 37.6, 37.7, 37.8, 38.1; 70/456 R

[56] References Cited

U.S. PATENT DOCUMENTS

| | | | |
|---|---|---|---|
| 2,274,820 | 3/1942 | Bills | 206/37.3 X |
| 2,306,970 | 12/1942 | MacPherson et al. | 206/37.4 X |
| 2,672,044 | 3/1954 | Martin | 206/37.1 X |
| 2,795,128 | 6/1957 | Ly | 206/37.4 X |
| 3,355,917 | 12/1967 | Albert | 206/37.2 X |
| 3,362,200 | 1/1968 | Lanier | 206/37.1 X |
| 4,307,590 | 12/1981 | Friedland | 206/37.1 X |
| 4,646,913 | 3/1987 | Wing et al. | 206/37.3 X |
| 4,941,569 | 7/1990 | Lindmayer et al. | 206/37.1 X |

*Primary Examiner*—David T. Fidei
*Assistant Examiner*—Jacob K. Ackun, Jr.
*Attorney, Agent, or Firm*—Albert O. Cota

[57] ABSTRACT

A key case (10) consisting of a first cover (12) and a second cover (28) that enclose a first and a second side-member (14,26) that have sandwiched between them a lower and an upper leaf spring (18,20). The springs control and maintain the retracted and extracted positions of an articulated first and second key (22,24). The keys have near their articulated points a straight receiving step (22B, 24B) and an angular stop (22C, 24C). The steps maintain the keys in a horizontal position and the stops maintain the keys at an angular position where each position is with respect to the horizontal plane of the key case (10). In a second configuration of the invention, two key cases (10) are joined at their sides to provide a key case with four keys. In either configuration when the keys are retracted, the key case (10) takes a very little space and its design prevents tearing or premature wearing of trouser pockets or purse linings.

13 Claims, 3 Drawing Sheets

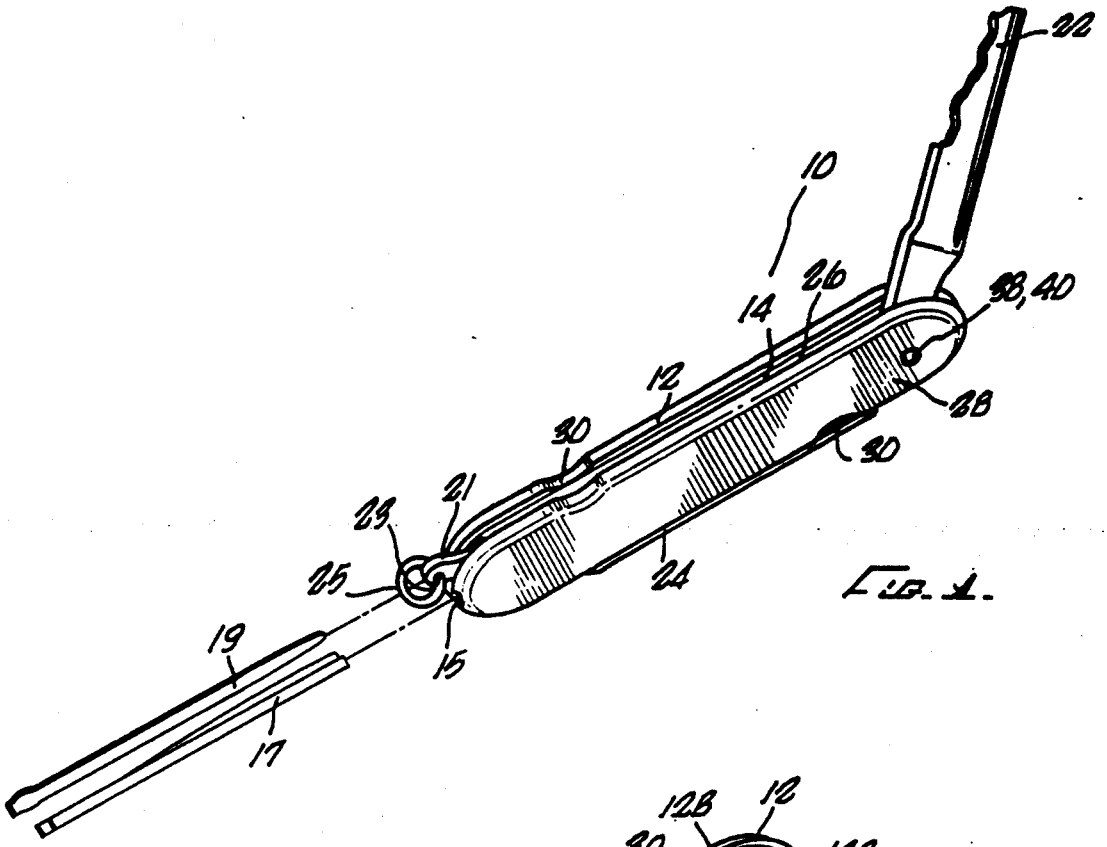
FIG. 1.
FIG. 2.
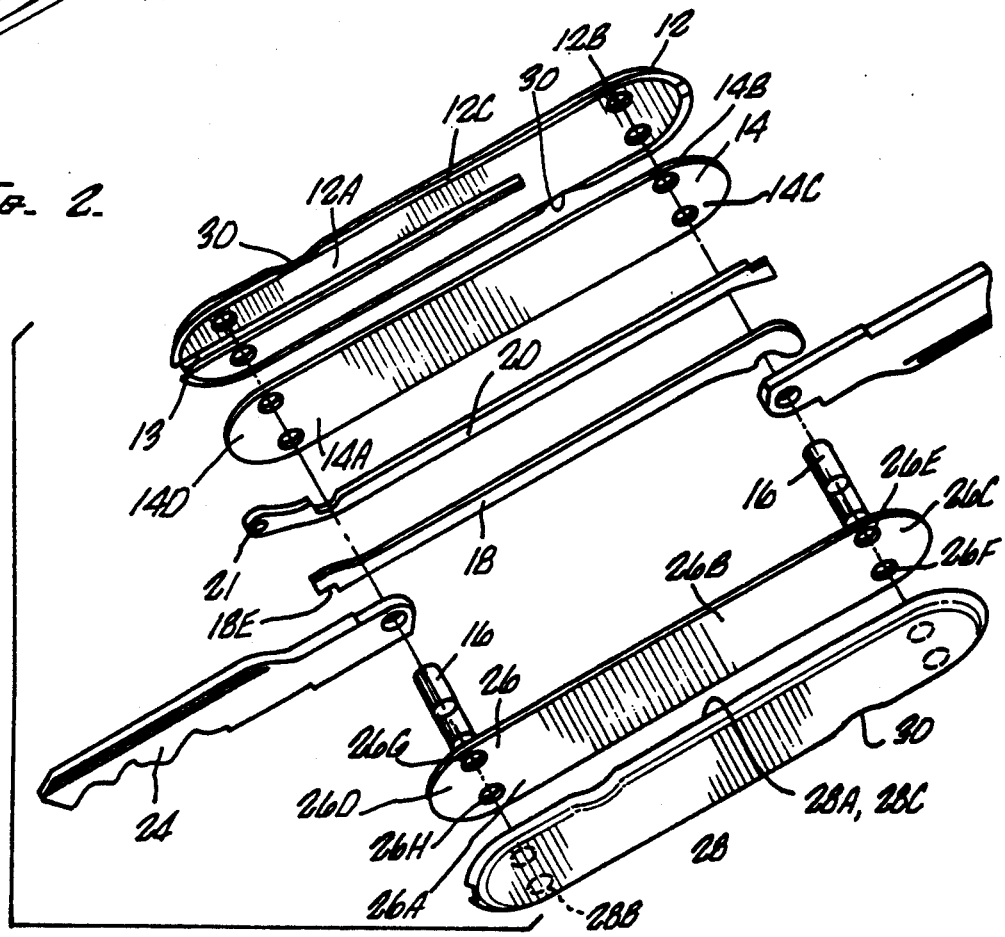

KEY CASE WITH RETRACTABLE KEYS

TECHNICAL FIELD

The invention pertains to the general field of key holders and more particularly to a small, flat key case that houses two keys and allows the keys to be selectively extracted from the key case and placed in either a horizontal or an angled position.

BACKGROUND ART

Keys are usually kept in groups and are conventionally carried in bulky key holders such as fold-over cases, key rings, snap hooks or chains that clip to belts or other parts of clothing. One of the most common key groupings is for operating a motor vehicle. Usually this grouping includes one key for the vehicle ignition and a second key to unlock the vehicle trunk and glove compartment. When two such keys are needed they are often kept on a key ring. When these rings are placed in trouser pockets or purses, the combination of the loose keys and the ring is abrasive and can cause the trouser pockets and purse lining to tear or wear out prematurely—especially if the person carrying the keys is at all active.

The basic design of the instant key case is particularly suited to house two keys such as are required to operate a motor vehicle. This key case is compact, slender and has a smooth housing that can be conveniently carried in trouser pockets or purses without causing wear to the pockets or purse.

A search of the prior art did not disclose any patents that read directly on the claims of the instant invention. However, the following U.S. patents are considered related:

| U.S. Pat. No. | INVENTOR | ISSUED |
|---|---|---|
| 4,941,569 | Lindmayer, et al | 17 July 1990 |
| 4,646,913 | Wing, et al | 3 March 1987 |
| 2,795,128 | Ly | 17 May 1955 |
| 2,274,820 | Bills | 9 July 1940 |

U.S. Pat. No. 4,941,569 discloses a rectangular key case housing having a swing-out flat key that is integrated into the case when the key is not being used. The case contains a key receiving space formed as a two-legged receiving shaft that is essentially L-shaped and extends with its larger leg along the side edge and its shorter leg along the front edge of the housing. In the front leg of the receiving shaft, the key is fastened to the housing by means of a pivot and is pivotable from the non-use position into a usable position projecting centrally from the front edge of the housing. This invention also features a transmitter for cordless remote actuation of a lock system.

U.S. Pat. No. 4,646,913 discloses a key holder that includes a casing having a flat base wall and a plurality of parallel, spaced-apart, elongated key compartment side walls. The walls extend integrally upwardly from the base wall to form a plurality of parallel key compartments. The keys are pivotally mounted in outer end portions of the key compartment side walls on removable cap screws and pivot about openings in the key heads. Leaf springs, one in each key compartment, push the keys against the side walls with sufficient force to frictionally hold the keys in whatever position the key is positioned by the user.

U.S. Pat. No. 2,795,128 discloses a key holder or case having individual compartments and individual keys that are retractable, when not in use, into their respective compartments. Yieldable mechanical fingers located in their respective compartments cooperate with the respective keys. These fingers exert spring pressure upon the keys to automatically pivot the keys for use. The key case is also designed with a key ejecting means that allows the key to be detached from the case to allow the key to remain in use if so desired.

U.S. Pat. No. 2,274,820 discloses a key case that is designed to carry a key in each end. The case is formed of two duplicate pieces of plastic that are held together by U-shaped wire springs. When pressure is applied to one side of the key case, the opposite side opens allowing a key to drop by gravity into a usable position. Likewise, when pressure is applied to the opposite end of the case, the second opposite key will drop into its usable position. A raised point may be located on one edge of the case to allow a user to distinguish one key from the other in the dark.

For background purposes and indication of the art to which the invention is related reference may be made to the following patents.

| U.S. Pat. No. | INVENTOR | ISSUED |
|---|---|---|
| 3,362,200 | Lanier | 9 January 1968 |
| 3,355,917 | Albert | 5 December 1967 |

DISCLOSURE OF THE INVENTION

The key case with retractable keys is made in a compact, slender and smooth package that is easily carried in a pocket or purse. The smooth and streamlined design of the key case prevents tearing, puncturing, and the premature wearing-out of trouser pockets and purse linings. The key case is disclosed in two configurations: the first has provisions for housing two retractable keys and is particularly suited to operate a motor vehicle that commonly requires an ignition key and a second key to open the trunk and glove compartment.

In the most basic design of the first configuration, the key case consists of six major elements: a first sidemember, a second sidemember, a lower leaf spring, an upper leaf spring, a first key and a second key.

The lower leaf spring has a first end that is pivotally mounted to the inner side of the first sidemember and a free-standing second end. The upper leaf spring lays atop the lower leaf spring and has a free-standing first end and a second end that is also privotally mounted to the inner side of the first sidemember. The free-standing end of each of the springs produces a spring force when the spring is pressed against the surface of the pivoted end of the interfacing spring.

The first key is articulately mounted at one end of the first sidemember above the free-standing first end of the upper leaf spring. Likewise, the second key is articulately mounted at the opposite end of the first sidemember below the free-standing second end of the lower leaf spring. The respective springs allow the first and second keys to be selectively extracted from their retracted positions to either a horizontal position or an angled position where both positions are with respect to the horizontal plane of the first sidemember. To maintain the key case in an assembled condition, the second sidemember is attached to the first sidemember by means of rivets that also function as the pivot pins for the springs and keys. To complete the key case, a first a second cover is attached to the respective first and second sidemembers.

In the second key case configuration, the first cover of a first key case is attached to the second cover of a second case by an attachment means. This design forms a key case that will accommodate four keys and still maintain a package that is relatively compact, smooth and that functions in a similar manner as that of the first configuration.

In both configurations, several enhancements may be incorporated into the basic key case to enhance the utility of the invention. For example, a narrow channel can be cut into the inside surface of one or both of the covers. When these covers are attached to the respective first and second sidemembers, a pocket is formed into which can be inserted and kept a toothpick or a set of tweezers. The first and second covers may also include aligned key-grip indentations that allow the edge of the keys to be easily grasped when the key is lifted into its usable position. Additionally, one of the leaf springs may be made with a contiguous extension that projects outward from the edge of the key case. The extension includes a bore therethrough into which a key ring may be inserted that allow a third key or a tether chain to be attached.

In view of the above disclosure, it is the primary object of the invention to provide a key case that is particularly suited to carry two retractable keys as would normally be needed to operate a motor vehicle. In addition to the primary object, it is also an object of the invention to provide a key case that:

- allows either of the two keys to be extracted to either a horizontal position or an angled position,
- includes a first and second cover that can made of any material, in a variety of colors, and that can include company names and logos,
- allows a particular key to be selected in the dark,
- is reliable and maintenance free, and
- is cost effective from both a manufacturer and consumer point of view.

BRIEF DESCRIPTION OF THE DRAWINGS

FIG. 1 is a perspective view of the key case with one key retracted and the other key extracted to its usable angular position.

FIG. 2 is an exploded view of the elements that comprise the key case,

BEST MODE FOR CARRYING OUT OF THE INVENTION

Figure 3:
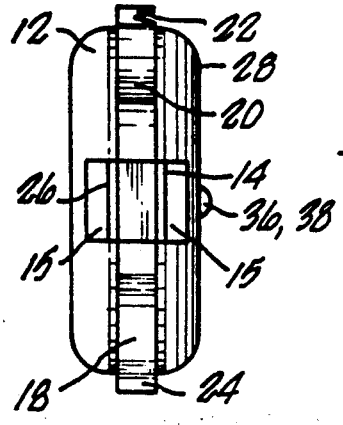
FIG. 3 is a back end view of the key case.

The best mode for carrying out the invention is presented in terms of a preferred embodiment having two configurations. In either case, the invention is designed to provide a key case 10 that is small, easy to carry and that houses at least two retractable keys.

The first configurations of the key case 10 as shown in FIGS. 1 through 8, consists, in order of assembly, of a first cover 12, a first sidemember 14, a set of four rivets 16, a lower leaf spring 18, an upper leaf spring 20, a first key 22, a second key 24, a second sidemember 26 and a second cover 28.

The first sidemember 14 is cut from a piece of metal such as steel and is in a substantially rectangular shape with rounded ends as best shown in FIG. 2. The sidemember has an inner side 14A, an outer side 14B, a first end 14C and a second end 14D. Near the first end 14C is a first upper bore 14E and a first lower bore 14F therethrough. Near the second end is likewise a second upper bore 14G and a second lower bore 14H.

Through each of these bores from the outer side 14B, is inserted a rivet 16 that functions to hold the first sidemember 14 to the second sidemember 26 and that serve as pins to retain the lower and upper leaf springs 18,20 and the first and second keys 22,24.

Figure 5:
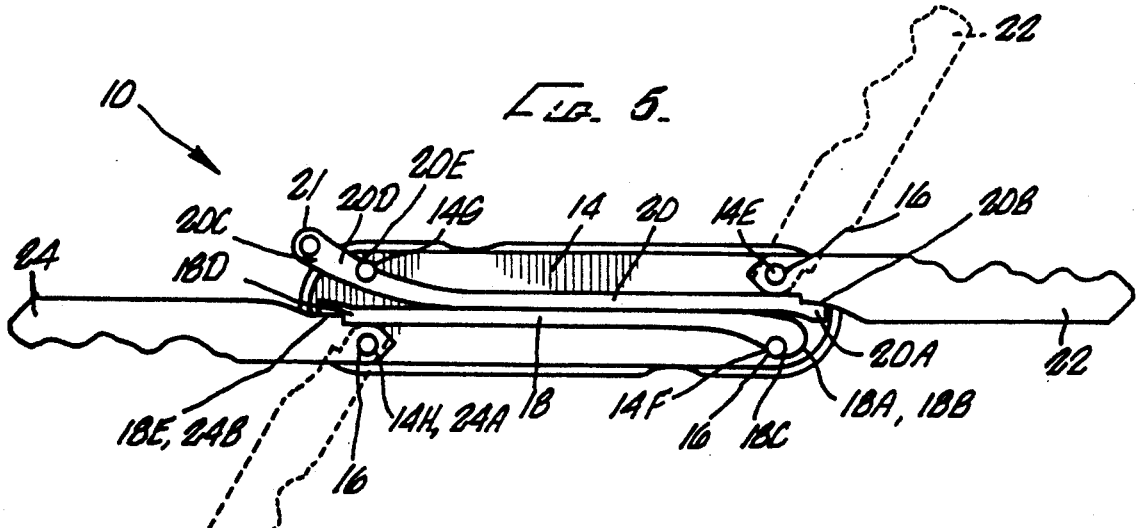
FIG. 5 is a side view of the key case with the front and second covers removed and showing the placement of the lower and upper leaf springs and the two extracted positions available for the two keys.
Figure 6:
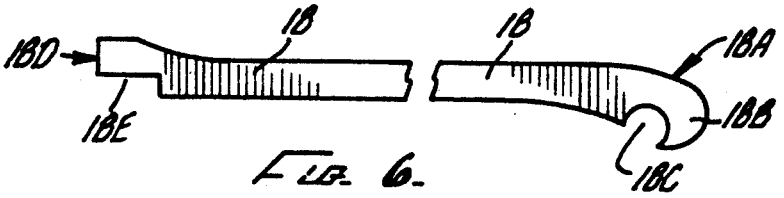
FIG. 6 is a partial side view of the lower leaf spring; the upper leaf spring being a mirror image of the lower leaf spring.

The lower leaf spring 18 as shown in FIGS. 2, 5 and 6 is sized to fit within the inside perimeter of the lower half of the first sidemember 14. The spring 18 consists of a first end 18A and a free standing second end 18D. The first end has a downwardly curved section 18B having a rivet slot 18C that is sized to receive the rivet 16 inserted through the first lower bore 14F. The free standing second end 18D has a downward facing key-lock step 18E that is located above the rivet 16 inserted through the second lower bore 14H.

The upper leaf spring 20 as shown in FIGS. 2 and 5 is an identical reverse structure of the first leaf spring 18 and is also sized to fit within the inside perimeter of the upper half of the first sidemember 14. The spring 20 is supported atop the lower leaf spring 18 and consists of a free standing first end 20A that has an upward facing key-lock step 20B located below the rivet 16 inserted through the first upper bore 14E. The second end 20C has an upwardly curved section 20D having a rivet slot 20E sized to receive the rivet 16 inserted through the second upper bore 14G.

To increase the utility of the key case, the curved section 18B or 20D of either or both of the lower or upper leaf sections 18,20 may have a contiguous extension 21 that projects outward from the edge of the first and second covers 12,28 as best shown in FIG. 1. The extension has a bore 23 therethrough that allows a key ring 25 to be inserted that further allows an additional key or small chain to be attached.

Figure 7:
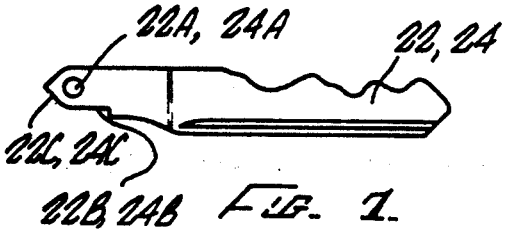
FIG. 7 is a side view of the first key; the second key being a mirror image of the first key.
Figure 9:
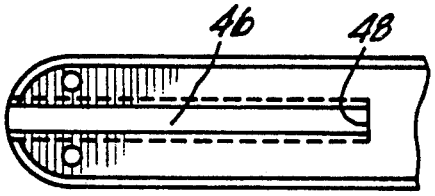
FIG. 9 is a partial side view of the second cover showing the location of a cover attachment groove.
Figure 10:
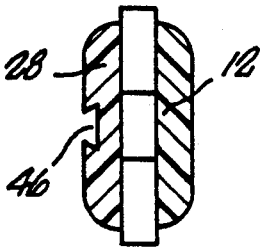
FIG. 10 is a sectional view of the key case showing the location of the groove on the second cover.
Figure 11:
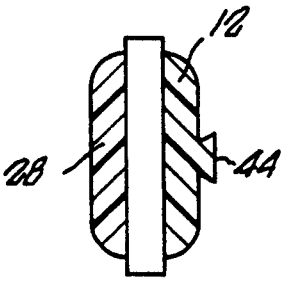
FIG. 11 is a sectional view of the key case showing the location of a tongue extrusion on the first cover that fits into the groove on the second cover.
Figure 13:
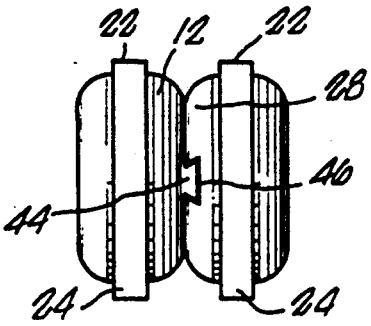
FIG. 13 is an end view showing a first key case attached to a second key case to form a key case with four keys.
Figure 12:
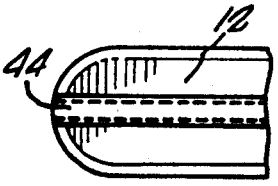
FIG. 12 is a partial side view of the first cover showing the location of the tongue extrusion.

In the preferred configuration of the key case 10, a first key 22 and a second key 24 are used as shown in FIGS. 2, 5 and 7.

The first key 22 as best shown in FIG. 7, has a rivet bore 22A near its back edge that rotatably fits into the rivet 16 inserted through the first upper bore 14E as shown in FIG. 5. Also, located near its back edge is a downward facing, straight receiving step 22B. When this step is interfaced with the upward facing, key-lock stop 20B as shown in FIG. 5, the key is substantially horizontally aligned with the first and second sidemembers 18,26. On the key's lower back edge is also located an angular stop 22C as best shown in FIG. 7, that is cut at an angle of 30±5 degrees. When the key 22 is rotated clockwise from its retracted position, the stop 22C interfaces with the upper edge of the upper leaf spring 20. This action in combination with the upward spring force provided by the spring, allows the key to remain set in an angular position with respect to the horizontal plane of the first and second sidemembers 14,26 as shown in phantom lines in FIG. 5. When the key is inserted into a lock, such as an ignition switch, the angled key allows the key case to use less outward space.

The second key 24 as best shown in FIGS. 2 and 5, has a rivet bore 24A near its back edge that rotatably fits into the rivet 16 inserted through the second lower bore 14H. The second key has near its back edge an upward facing straight receiving step 24B. When this step interfaces with the lower facing key-lock stop 18E the second key 24 is substantially horizontally aligned with the first and second sidemembers 18,26. On the key's upper back edge is located an angular stop 24C as shown in FIG. 5 that is cut at an angle of 30±5 degrees. When the key 24 is rotated counter-clockwise from its retracted position, the stop 24C interfaces with lower edge of the lower leaf spring 18. The upward force provided by the spring allows the key to remain in an angular position with respect to the horizontal plane of the first and second sidemembers 18,26.

The second sidemember 26 is also cut from steel and has an identical shape as that of the first sidemember 12 with an inner side 26A, an outer side 26B, a first end 26C and a second end 26D. Near the first end 26C is located a first upper bore 26E and a first lower bore 26F. These bores respectively fit into the rivets 16 extending from the first upper bore 14E and first lower bore 14F on the first sidemember 14. Near the second end 26D there is located a second upper bore 26G and a second lower bore 26H. These bores respectively fit into the rivets 16 extending from the second upper bore 14G and second lower bore 14H on the first sidemember. The four rivets are peened on the outer side 26B of the second sidemember 26 to maintain the two sidemembers together. The two sidemembers in combination with the width of the lower and upper leaf springs 18,20 create a key cavity that allows the keys 22,24 to remain retracted when not being used.

To complete the first configuration of the key case 10 a first cover 12 and a second cover 28 are attached to the outer sides 14B,26B of the first and second sidemembers 14,26.

The first cover 12 may be made of any material such as metal, wood or plastic with an impact resistant plastic preferred. The cover 12 has a similar shape as that of the first sidemember 14 but with larger overall dimensions. On its inside surface 12A it has four cavities 12B that are aligned and sized to fit over the respective rivets 16 extending from the outer side 14B of the first sidemember 14. The cover has a gripping ledge 12C around its inside perimeter that is sized to frictionally fit over and attach to the perimeter edge of the first sidemember 14.

The second cover 28 is likewise configured with four cavities 28B cut into its inside surface 28A and a gripping ledge 28C that also allows the second cover to be attached to the second sidemember 26.

To increase the utility of the key case 10, the following enhancements can be added:

A longitudinal narrow channel 13 can be formed into the inside surface of either the first or second cover 12,28 as shown in FIG. 2. The channels extend from near the center of the covers through the perimeter edge. When the covers are attached to their respective first and second sidemembers 14,26 a pocket 15 is created as shown in FIG. 3 into which a tool such as tweezers 17 or a toothpick 19 can be captively stored until extracted for use as shown in FIG. 1.

The first and second covers 12,28 may include aligned key grip indentations 30 that are located on each longitudinal edge at the point where the edge of first and second keys 22,28 protrude from the edge of the covers. The indentations 30 allow the edge of the respective key to be easily grasped when the key is lifted into its usable position.

Figure 8:
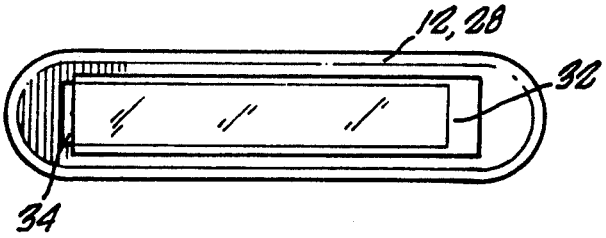
FIG. 8 is a side view of a key case having a transparent pocket into which is inserted an identification insert.

A further enhancement disclosed is a longitudinally extending transparent pocket 32 that is attached to the side of either cover 12,28 as shown in FIG. 8, by an attachment means such as an adhesive. Into the pocket is then inserted an identification insert having selected printed data.

Figure 4:
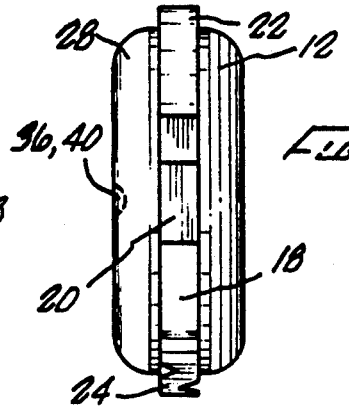
FIG. 4 is a front end view of the key case.

The final enhancement disclosed is the inclusion of a key identification means 36 that is provided near the end of at least one of the first or second covers 12,28. The key identification means may consist of either a small protrusion 38 as shown in FIG. 3 or a small dimple 40 as shown in FIG. 4. In either case, the identification means allows the correct key to be found in the dark.

The second configuration of the key case 10 as shown in FIGS. 9 through 13, allows multiple key cases to be joined together to produce an integral key case that includes at least four keys. In its simplest embodiment, the first cover 12 of a first key case is attached to the second cover 28 of a second key case by a cover attachment means to form a compact key case having four keys.

The cover attachment means may simply consist of an adhesive, or the first cover 12 of the first key case 10 may include a longitudinally centered tongue extrusion 44. The second cover 28 of the second key case 10 has a complimentary groove 46 having a stop 48. When the tongue is inserted into the groove the key case with four keys is formed.

To use the key case 10 either the first key 22 or second key 24 may be lifted from its retracted position within the confines of the first and second covers 12,28. Either key may be extended fully to a position that is horizontal with the key case or, the key may be partially extended to its angular position. When the keys are not in use, they are both retracted into the key case 10.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

We claim:

1. A key case with retractable keys comprising:

a) a first sidemember, b) a lower leaf spring having a first end that is pivotally mounted to the inner side of said first sidemember and a second end that is free standing, c) an upper leaf spring that lays atop said lower leaf spring and having a free-standing first end and a second end that is pivotally mounted to the inner side of said first sidemember, where the free-standing end of each said spring produces a spring force when each of said springs is pressed against the pivoted end of the interfacing said spring, d) a first key articulately mounted at one end of said first sidemember above the free-standing first end of said upper leaf spring, e) a second key articulately mounted at the opposite end of said first sidemember below the free-standing second end of said lower leaf spring, where the respective said springs allow said first and second keys to be selectively extracted from their retracted positions to either a horizontal position or an angled position, and f) a second sidemember that is attached to said first sidemember by means of rivets which also function as the pivot pins for said springs and keys, where said second sidemember maintains said key case in an assembled condition.

2. A key case with retractable keys comprising:

a) a first sidemember comprising:

(1) an inner side and an outer side, (2) a first end having a first upper bore and a first lower bore therethrough, (3) a second end having a second upper bore and a second lower bore, b) a rivet inserted through each of said bores from the outer side of said first sidemember, c) a lower leaf spring sized to fit within the inside perimeter of the lower half of said first sidemember, said lower leaf spring comprising:

(1) a first end with a downwardly curved section having a rivet slot sized to receive the rivet inserted through said first lower bore, (2) a free standing second end having a downward facing key lock step located above the rivet inserted through said second lower bore, d) an upper leaf spring sized to fit within the inside perimeter of the upper half of said first sidemember and supported atop said lower leaf spring, said second leaf spring comprising:

(1) a free standing first end having an upward facing key lock step located below the rivet inserted through said first upper bore, (2) a second end with an upwardly curved section having a rivet slot sized to receive the rivet inserted through siad second upper bore, e) a first key having:

(1) a rivet bore near its back edge that rotatably fits into the rivet inserted through said first upper bore, (2) a downward facing straight receiving step also located near its back edge and that when interfaced with the upward facing, key-lock step said first key is substantially horizontally aligned with said first and second sidemembers, (3) an angular stop located on the key's lower back edge such that when said key is rotated clockwise the stop interfaces with the upper edge of said upper leaf spring to allow said key to remain in an angular position with respect to the horizontal plane of said first sidemember, f) a second key having:

(1) a rivet bore near its back edge that rotatably fits into the rivet inserted through said second lower bore, (2) an upward facing straight receiving step also located near its back edge and that when interfaced with the lower facing key-lock step said second key is substantially horizontally aligned with said first sidemember, 3) an angular stop located on the key's upper back edge such that when said key is rotated counter clockwise the stop interfaces with the lower edge of said lower leaf spring to allow said key to remain in an angular position with respect to the horizontal plane of said first sidemember, g) a second sidemember comprising:

(1) an inner side and an outer side, (2) a first end having a first upper bore and a first lower bore that respectively fit into the rivets extending from the first upper bore and the first lower bore on said first sidemember, and (3) a second end having a second upper bore and a second lower bore that respectively fit into the rivets extending from the second upper bore and the second lower bore on said first sidemember, where the four rivets in combination with the width of said lower and upper leaf springs maintain said first and second sidemembers together and create a key cavity that allows said keys to remain retracted when not in use.

3. The key case as specified in claim 2 further comprising:

a) a first cover having four cavities extending into its inside surface, where said cavities are aligned with and sized to fit over said respective rivets extending from the outer side of said first sidemember, with said first cover further having a gripping ledge around its inside perimeter sized to frictionally fit over and attach to the perimeter edge of said first sidemember, and b) a second cover having four cavities extending into its inside surface, where said cavities are aligned with and sized to fit over said respective rivets exending from the outer surface of said second side member with said second cover further having a retention ledge around its perimeter sized to frictionally fit over and attach to the perimeter edge of said second member.

4. The key case as specified in claim 3 wherein said first cover further comprises a longitudinal narrow channel cut into the inside surface of said first cover and extending from the center of said first cover through its perimeter edge, where said channel and the respective outer side of said first sidemember create a pocket into which a tool such as a toothpick can be captively stored until extracted for use.

5. The key case as specified in claim 3 wherein said second cover further comprises a longitudinal narrow channel cut into the inside surface of said second cover and extending from the center of said second cover through its perimeter edge, where said channel and the respective outer side of said second sidemember create a pocket into which a tool such as a pair of tweezers can be captively stored until extracted for use.

6. The key case as specified in claim 3 wherein said first and second covers further having aligned key grip indentations located on each longitudinal edge at the point where the edge of said keys protrude from the edge of said covers where said indentations allow the edge of the respective key to be easily grasped when said key is lifted into its usable position.

7. The key case as specified in claim 2 wherein the curved section of said lower or upper leaf spring further comprises a contiguous extension that projects outward from the edge of said first and second covers with said projection having a bore therethrough that allows a key ring to be attached.

8. The key case as specified in claim 3 wherein said first or second covers further comprise a longitudinally extending transparent pocket that is attached to said covers by an attachment means, where into said pocket may be inserted an identification insert.

9. The key case as specified in claim 3 wherein at least one of said first or second covers further comprises near its end a key identification means.

10. The key case as specified in claim 9 wherein said key identification means comprises a small protrusion.

11. The key case as specified in claim 9 wherein said key identification means comprises a small dimple.

12. The key case as specified in claim 3 wherein said first cover of a first key case is attached to said second cover of a second key case by a cover attachment means to form a key case having four keys.

13. The key case as specified in claim 12 wherein said cover attachment means comprises:

a) said first cover of said first key case having a longitudinally centered tongue extrusion, and b) said second cover of said second key case having a complimentary groove having a stop, where when said tongue is inserted into said groove said key case with four keys is formed.

* * * * *